US009268293B2

(12) United States Patent
Nakao et al.

(10) Patent No.: US 9,268,293 B2
(45) Date of Patent: Feb. 23, 2016

(54) OPENING-CLOSING MECHANISM AND IMAGE-FORMING APPARATUS

(71) Applicant: CANON KABUSHIKI KAISHA, Tokyo (JP)

(72) Inventors: Kenichi Nakao, Suntou-gun (JP); Shinkichi Yamamoto, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/293,215

(22) Filed: Jun. 2, 2014

(65) Prior Publication Data

US 2014/0369713 A1 Dec. 18, 2014

(30) Foreign Application Priority Data

Jun. 13, 2013 (JP) ..... 2013-125006

(51) Int. Cl.
*G03G 15/08* (2006.01)
*G03G 21/16* (2006.01)
*G03G 15/00* (2006.01)

(52) U.S. Cl.
CPC ..... *G03G 21/1633* (2013.01); *G03G 15/5016* (2013.01)

(58) Field of Classification Search
CPC ..... H04N 1/00533; H04N 1/00535; G03G 21/1633; G03G 21/1638; G03G 2221/169
See application file for complete search history.

(56) References Cited

U.S. PATENT DOCUMENTS 7,773,910 B2 * 8/2010 Jeong et al. ..... 399/107
2008/0157639 A1 * 7/2008 Jeong et al. ..... 312/237

FOREIGN PATENT DOCUMENTS

JP 2007-030216 A 2/2007

* cited by examiner

*Primary Examiner* — Clayton E Laballe
*Assistant Examiner* — Geoffrey Evans
(74) *Attorney, Agent, or Firm* — Fitzpatrick, Cella, Harper & Scinto

(57) ABSTRACT

A movable member is movable with respect to a main body in conjunction with movement of an opening-closing member while changing a posture relative to the opening-closing member such that a gap between the movable member and the opening-closing member is gradually reduced when the opening-closing member moves from an open position toward a closed position. The movable member is configured such that when an article is inserted into the gap during the movement of the opening-closing member from the open position toward the closed position, a movement path is switched, by a reaction force received from the article inserted into the gap, from a first path along which the movable member moves while reducing the gap to a second path in which the gap is not reduced.

19 Claims, 16 Drawing Sheets

OPENING-CLOSING MECHANISM AND IMAGE-FORMING APPARATUS

BACKGROUND OF THE INVENTION

1. Field of the Invention

The present invention relates to an opening/closing mechanism of an image-forming apparatus.

2. Description of the Related Art

An example of an image-forming apparatus, such as a copier, a printer, or a facsimile machine, is provided with a display and operation panel unit including a display unit that indicates the operation method of the apparatus, such as toner replenishment and removal of jammed paper, to an operator, and an input unit allowing the operator to perform the operations. The operations of toner replenishment and removal of jammed paper are not always performed by a person skilled in those operations. Therefore, it is preferred that the operator could perform the operations while following the operation guidance shown on a display screen. In recent years display units which are larger in size than the conventional units have been used to improve the convenience for the user. Meanwhile, from the standpoint of reducing the product in size and improving the design thereof, a stronger demand has been created for configurations in which the display and operation panel is effectively accommodated without protruding from the product. In order to meet such a demand, a configuration has been suggested in which the operator can perform operations while viewing the image displayed on the display unit, and the display and operation unit is moved to a position in which the operations of toner replacement and removal of jammed paper are not hindered. For example, Japanese Patent Application Publication No. 2007-30216 discloses an opening-closing mechanism configured such that a liquid crystal display unit is mounted integrally on a cover, which is an opening-closing member for opening the apparatus interior, and rotated in conjunction with the opening-closing operation of the cover, and the display direction thereof can be substantially maintained regardless of the cover posture. More specifically, when the apparatus interior is open, the cover is in a state of entirely opening the front surface and the operator is provided with a sufficient operation space, while the liquid crystal display unit assumes a posture different from that of the cover, maintains a state facing the front of the operator and displays indications to the operator.

SUMMARY OF THE INVENTION

A problem inherent to the conventional opening-closing mechanism is explained below with reference to FIGS. 2A to 2F. FIGS. 2A to 2F are schematic diagrams explaining the configuration of the conventional opening-closing mechanism. The image-forming apparatus (laser beam printer) shown in FIGS. 2A to 2F is configured such that a display panel 41 operates in conjunction with the opening-closing operation of a cover 42 serving as an opening-closing member that is opened and closed when a toner cartridge (referred to hereinbelow as CRG) is replaced or jammed paper is removed. FIG. 2A shows a state in which the cover 42 is closed. FIG. 2C shows a state in which the cover 42 is open. FIG. 2E shows the posture in the course of the operation of opening and closing the display panel 41 and the cover 42.

As shown in FIG. 2C, the cover 42 forms an opening larger than that of the display panel 41 to facilitate the CRG replacement operation in the open posture. Meanwhile, when the operator opens the cover 42, the display panel 41 is moved by a four-joint mechanism to a position shown in FIG. 2C in conjunction with the opening-closing operation of the cover 42. The display panel 41 changes the orientation and moves to the position shown in FIG. 2C in order to substantially maintain the posture that can be easily viewed by the operator in the open state of the cover 42. Thus, the display panel 41 is opened and closed through an operation trajectory different from that of the cover 42.

FIGS. 2B, 2D, and 2F are schematic cross-sectional views in which the operations of the display panel 41 and the cover 42 in the postures shown in FIGS. 2A, 2C, and 2E, respectively, are viewed from the main body right-side surface direction (rotation axis direction). FIG. 2B shows a state in which the cover 42 is entirely closed. FIG. 2D shows a state in which the cover 42 is entirely open. FIG. 2F shows a state in which an article is inserted into a gap between the display panel 41 and the cover 42 and the cover 42 is incompletely closed.

In FIG. 2D, the reference numeral 43 stands for a top cover of the product, 44—an arm that holds the cover 42 and rotates integrally with the cover 42, 45—a link member constituting part of the four joint link mechanism, and 46—a base member holding the link member 45. Further, an angle formed by the cover 42 and the main body top cover 43 in the closed state (portions which are at a substantially same angle (parallel to each other) in FIG. 2B) are in the open state (FIG. 2D) is denoted by a. Likewise, an angle formed by the surface portions of the cover 42 and the display panel 41 when the portions which are at a substantially same angle in the closed state are in the open state is denoted by $\beta$. When the cover 42 and the display panel 41 are closed from the open posture, the cover 42 rotates counterclockwise about a rotation shaft 43*a* in FIG. 2D, and the other members, including the link member 45 and the display panel 41, rotate in the directions shown by the arrows in FIG. 2D in conjunction with the movement of the cover 42. Therefore, when the cover 42 and other members are closed, the angle $\alpha$ and the angle $\beta$ gradually decrease following the rotation of the cover 42.

A problem associated with the above-described opening-closing mechanism is that the operator can easily erroneously insert an article into the spatial B portion in FIG. 2D, as shown in FIG. 2F. The opening of the spatial A portion and spatial C portion in FIG. 2D also can be closed by the rotation of the cover 42 or the like, the gap in the A portion and C portion generally can be easily predicted to decrease when the cover is closed, and it would be easy for the operator to be careful not to insert an article. Meanwhile, since the B portion performs a comparatively complex action using the multijoint link, it would be difficult to understand in a typical operation that the angle $\beta$ decreases in conjunction with the rotation of the cover 42.

Further, the size change of the gap in the A portion and C portion can be easily viewed from the operation position (front surface of the apparatus) of the operator, but the B portion is a gap formed between the portions (portions arranged side by side in the rotation axis direction) arranged side by side transversely, as viewed form the operation position, and is difficult to see from the operation position.

Where the opening-closing operation is continued in the state in which an article is inserted into the gap, the jammed article as well as parts of the apparatus will be damaged.

It is an object of the present invention to provide an opening-closing mechanism in which an article inserted into a gap can be prevented from being jammed even stronger.

It is another object of the present invention to provide an opening-closing mechanism comprising:

an opening-closing member provided to be movable with respect to a main body of an image-forming apparatus, between an open position in which the interior of the main body is open and a closed position in which the interior of the main body is closed; and a movable member provided to be movable with respect to the main body in conjunction with the movement of the opening-closing member such that a gap between the movable member and the opening-closing member is reduced as the opening-closing member moves from the open position toward the closed position, wherein where an article is not inserted into the gap between the movable member and the opening-closing member and when the opening-closing member moves from the open position toward the closed position, the movable member moves along a first path, and where an article is inserted into the gap between the movable member and the opening-closing member and when the opening-closing member moves from the open position toward the closed position, the movable member moves along a second path which is different from the first path and in which the gap is not reduced.

Further features of the present invention will become apparent from the following description of exemplary embodiments (with reference to the attached drawings).

DESCRIPTION OF THE EMBODIMENTS

An embodiment of the invention will be explained below in greater detail on the basis of examples thereof with reference to the appended drawings. The dimensions, materials, shapes, and mutual arrangements of constituent parts described in the embodiment should be changed, as appropriate, according to the configuration of the apparatus using the invention and various conditions. Thus, the scope of the invention is not limited to the below-described embodiment.

Example 1

The opening-closing mechanism according to an example of the invention is provided in an image-forming apparatus forming images on sheets or the like as a recording medium by using the so-called electrophotographic image forming process. Such an image-forming apparatus should perform a series of operations of transferring a toner image formed by the electrophotographic image forming process to the sheet and fixing the toner image by applying heat and pressure, and has a sheet feed device and a mechanism for transporting the sheet inside the apparatus. The opening-closing mechanism is provided such that a sheet transportation path provided inside the apparatus could be open to the outside for the purpose of maintenance or the like, and this mechanism is configured to be operated by the operator.

(Configuration of Entire Image-Forming Apparatus)

Figure 1:
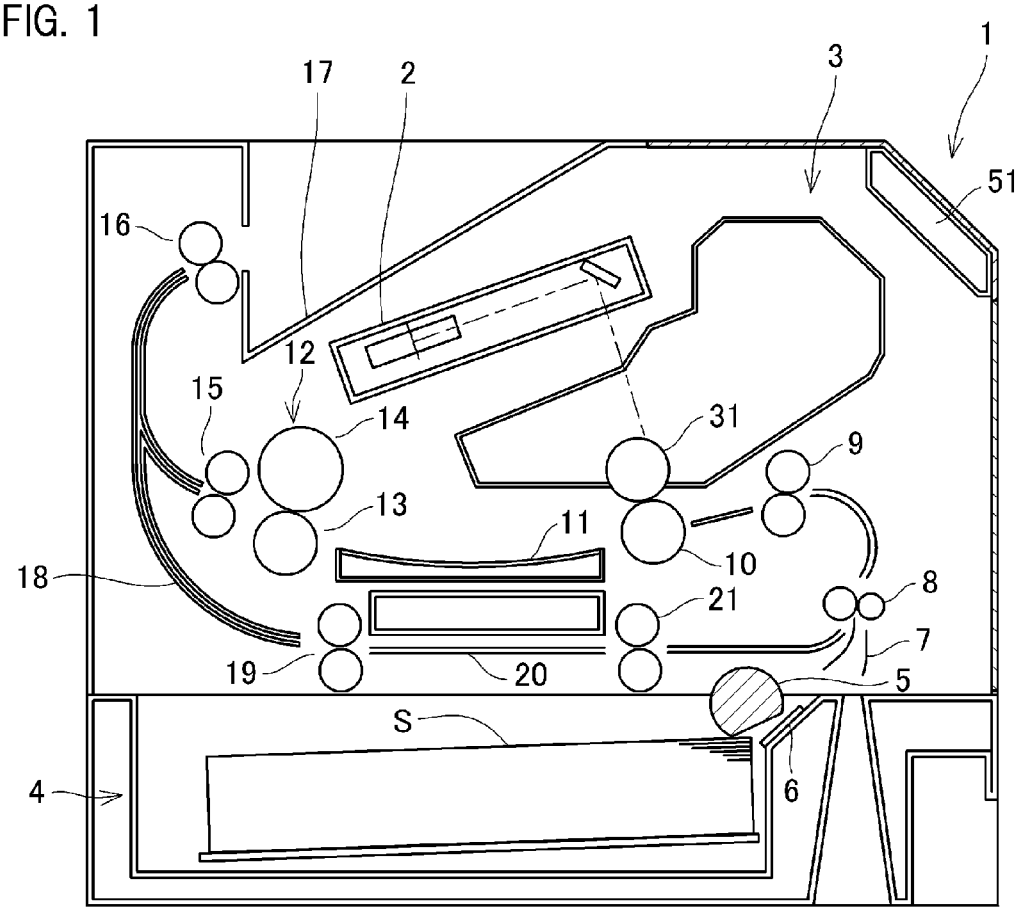
FIG. 1 is a schematic cross-sectional view showing the configuration of the image-forming apparatus according to an example of the present invention.
Figure 2A:
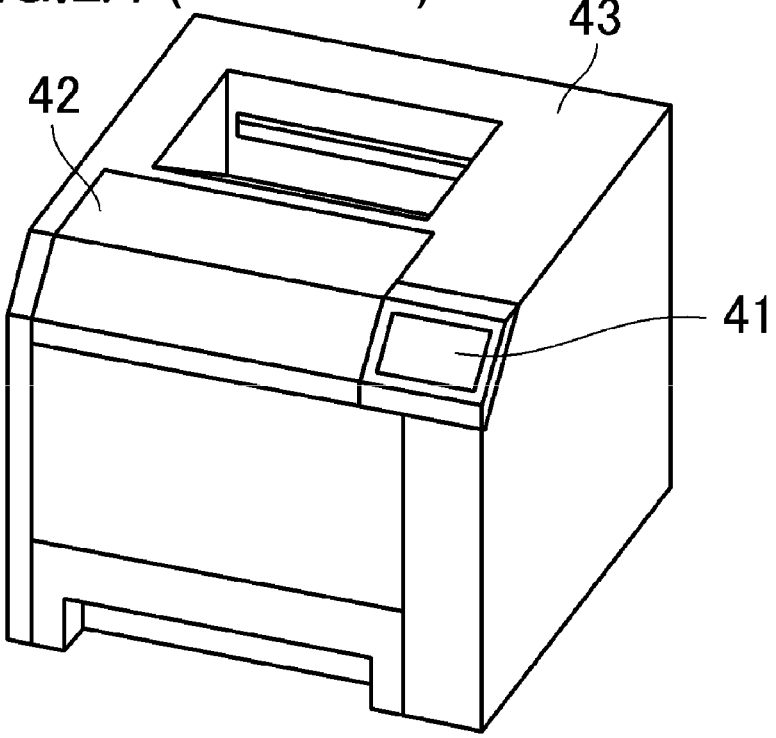
FIG.2A (Prior Art)
FIGS. 2A to 2F are schematic diagrams showing the configuration of the conventional opening-closing mechanism.
Figure 2B:
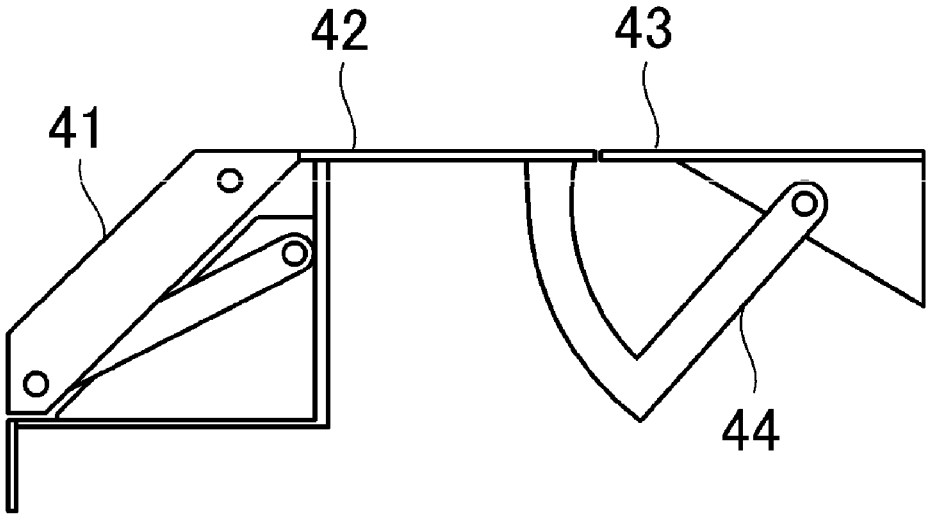
FIG.2B (Prior Art)
Figure 2C:
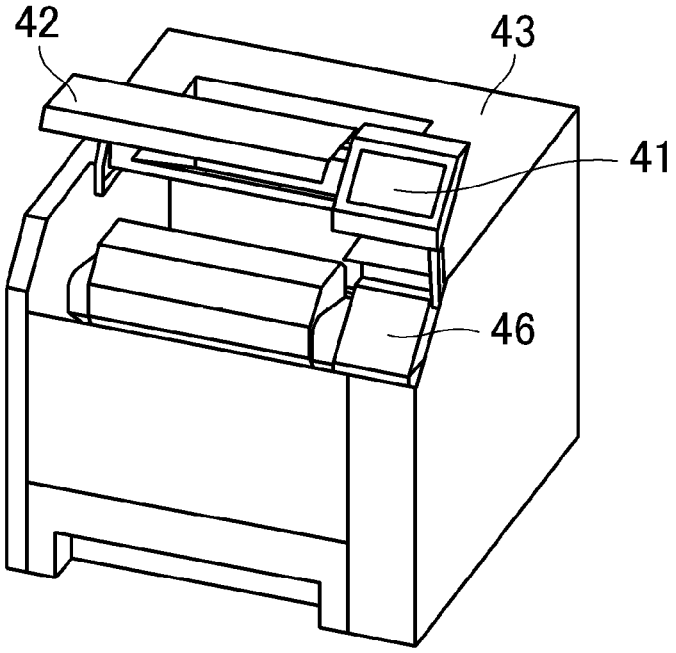
FIG.2C (Prior Art)
Figure 2D:
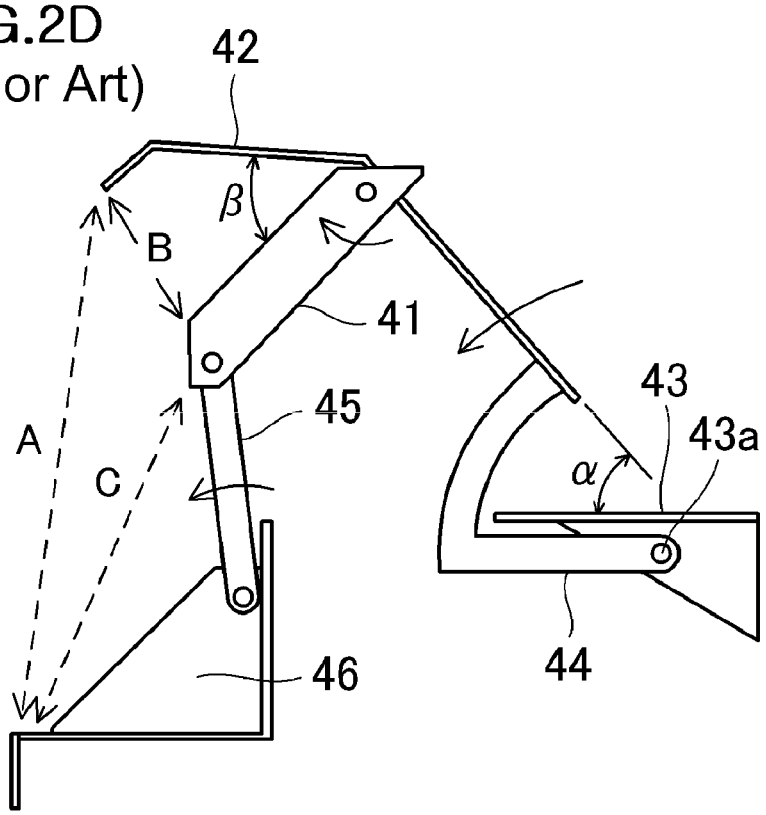
FIG.2D (Prior Art)
Figure 2E:
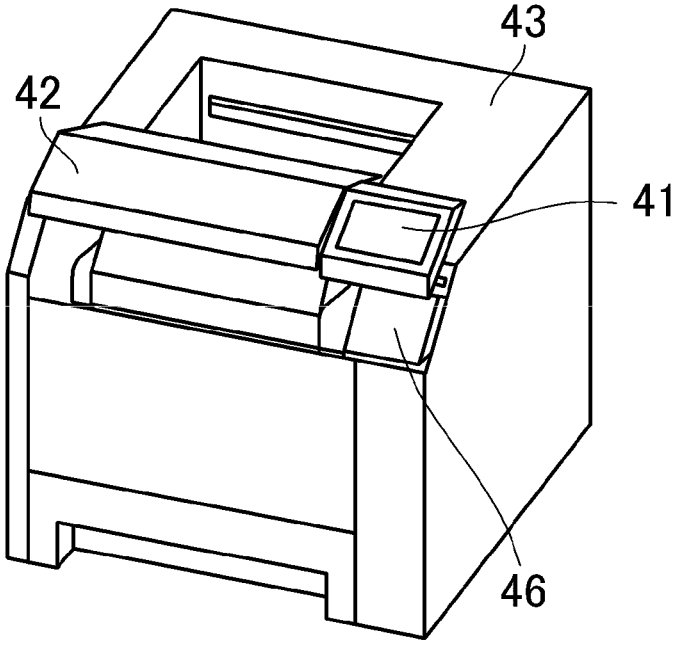
FIG.2E (Prior Art)
Figure 2F:
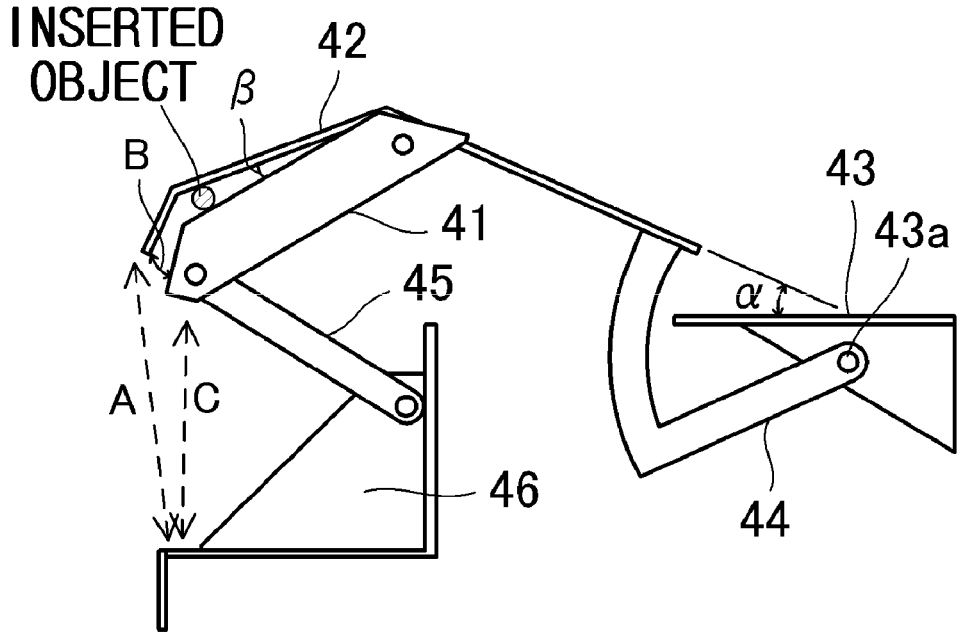
FIG.2F (Prior Art)

FIG. 1 is a schematic cross-sectional view illustrating the configuration of the image-forming apparatus of an example of the present invention. In the image-forming apparatus 1 according to the present example, a photosensitive drum 31, which is a drum-shaped electrophotographic photosensitive body, is irradiated by optical means 2 equipped with a laser diode, a polygon mirror, a lens, and a reflecting mirror with a laser beam corresponding to image information obtained with an external device (not shown in the figure). As a result, an electrostatic latent image corresponding to the image information is formed on the photosensitive drum 31. This latent image is developed with development means configured inside a process cartridge 3.

Sheets S, which are a recording medium, are stacked in a paper feed tray 4 located below the image-forming apparatus, the sheets fed out by a paper feed roller 5 are separated from each other with a separation unit 6 and transported along a transportation guide member 7. The sheets S inside the paper feed tray 4 are fed by a transportation roller pair 8 disposed downstream of the separation unit 6 and transported to a resist roller pair 9 disposed downstream thereof to perform skew correction.

The sheet S is then supplied between the photosensitive drum 31 and a transfer roller 10 by the resist roller pair 9 transporting the sheet at a timing corresponding to the formation of the latent image on the photosensitive drum 31. The transfer roller 10 serving as transfer means is disposed at a transfer position and transfers the toner image present on the photosensitive drum 31 onto the sheet S by applying a voltage. The sheet S to which the toner image has been transferred is then supplied along the transportation guide 11 to a fixing apparatus 12, and fixing processing for fixing the transferred toner image to the sheet S is performed herein. The fixing apparatus 12 is provided with a driver roller 13 and a fixing roller 14 incorporating a heater, and fixes the transferred toner image to the sheet S by applying heat and pressure to the sheet S passing therethrough.

The present image-forming apparatus has a two-side print mode in which printing is performed on both surfaces of the sheet S and a one-side print mode. When the sheet is transported in the one-side print mode, the sheet S subjected to the fixing processing is discharged to a discharge paper tray 17 located outside the apparatus with an inner discharge roller pair 15 and a paper discharge switchback roller pair 16. In the case of the two-side print mode, the sheet is temporarily stored by the paper discharge switchback roller pair 16 on an intermediate tray 20 through a re-feed path 18 and a firsts re-feed paper roller pair 19. The sheet S stored on the intermediate tray 20 is then transported to the transportation roller pair 8 by a second re-feed paper roller pair 21 to form an image on the second surface and thereafter discharged to the outside of the apparatus by the same process as used in one-side printing.

The reference numeral 51 stands for a display and operation panel (referred to hereinbelow as display panel) used by the operator to display various types of information on the image-forming apparatus and operate the apparatus. The display panel 51 includes a display unit that indicates the operation method of the apparatus, such as toner replenishment by exchanging the process cartridge 3 and removal of jammed paper, to the operator, and an input key unit allowing the operator to perform the operations. As shown in FIG. 1, in the present example, the display panel 51 is configured such as not to protrude to the outside in the cross section of the image-forming apparatus in order to reduce the size thereof.

[Configurations of Opening-Closing Cover and Display Panel]

FIGS. 3A to 3H are schematic drawings showing the configuration of the opening-closing mechanism according to Example 1 of the present invention. The opening-closing mechanism according to the present example includes a cover 52 as an opening-closing member provided to be capable of moving between an open position in which the interior of a main body of the image forming apparatus 1 is open and a closed position in which the interior of the main body is closed, and the display panel 51 as a movable member that moves in conjunction with the movement of the cover 52. When the cover 52 is in the open position, the process cartridge 3 can be attached to and detached from the main body of the image forming apparatus 1. In addition, when the cover 52 is in the open position, the operator can perform operations including the removal of jammed paper in the main body of the image forming apparatus 1.

Figure 3A:
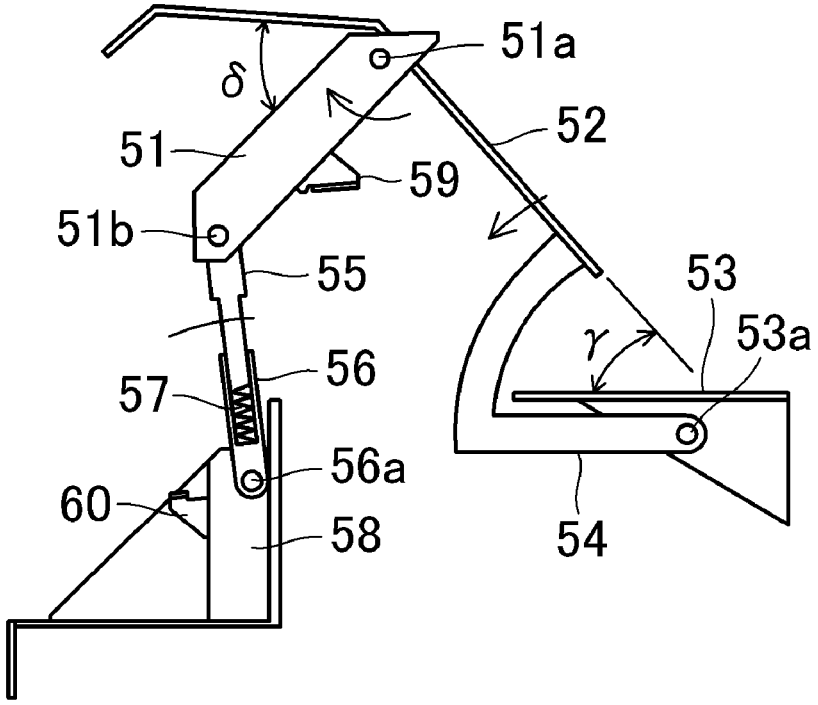
FIGS. 3A to 3H are schematic drawings showing the configuration of the opening-closing mechanism according to Example 1 of the present invention.
Figure 3B:
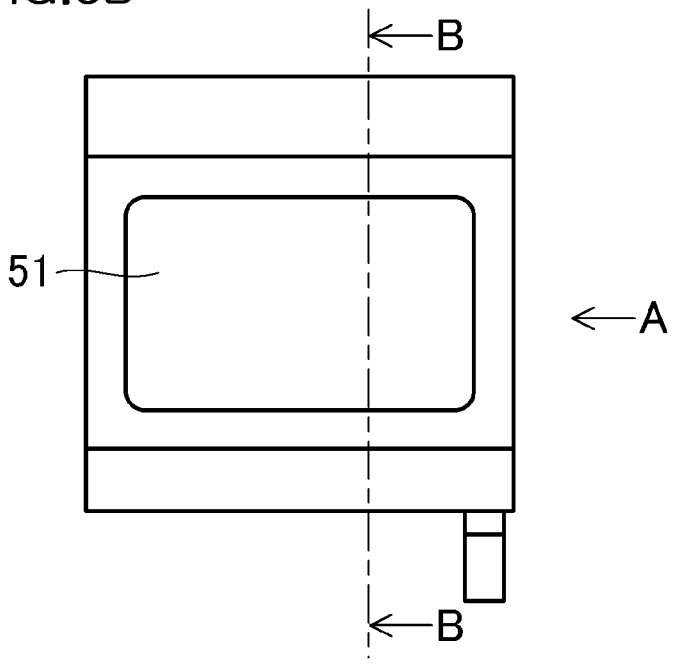
Figure 3C:
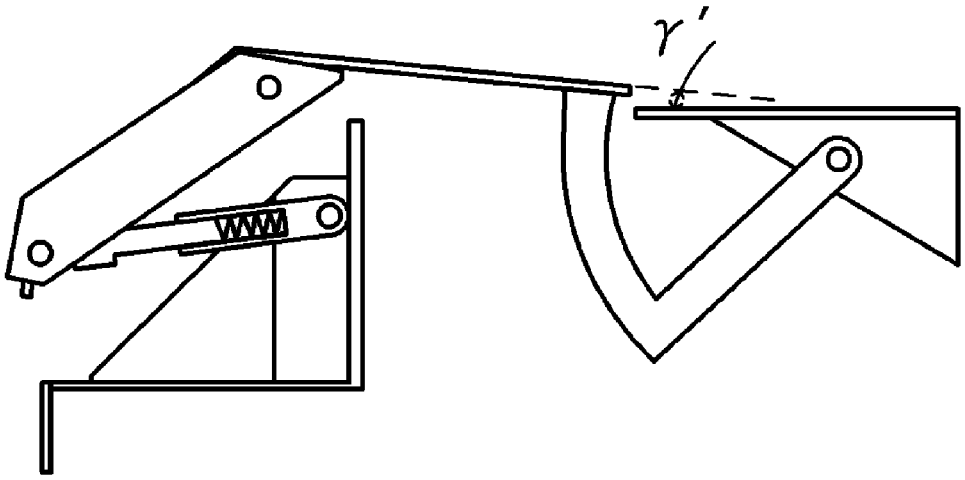
Figure 3D:
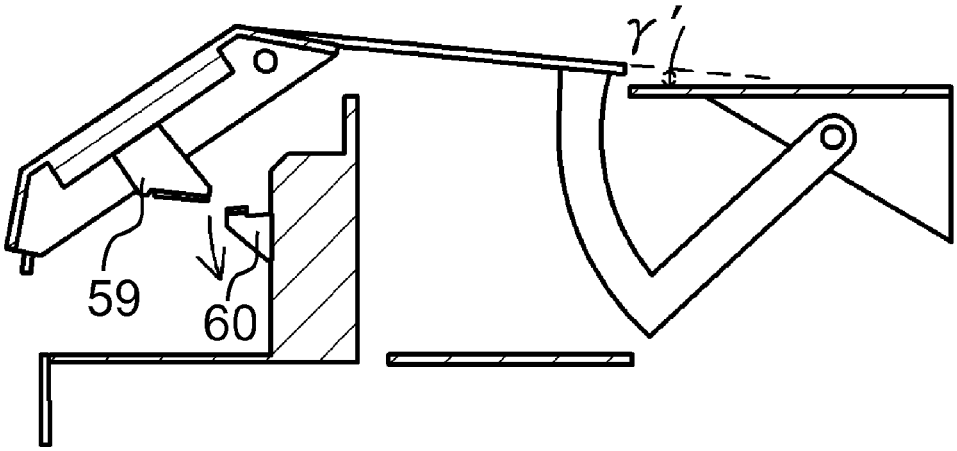

FIGS. 3A, C, E, and G are schematic side views (views taken along the arrow A in FIG. 3B) of the opening-closing mechanism according to the present example which are taken in the direction of rotation axes of the opening-closing member and movable member; those figures show the operation of the opening-closing mechanism. FIG. 3B is a schematic enlarged view of the display panel 51 taken from the front surface side of the apparatus. FIGS. 3D, F, and H are schematic cross-sectional views (views taken along the cross section BB in FIG. 3B) of the opening-closing mechanism according to the present example that are taken in the direction of rotation axes of the opening-closing member and movable member; those figures show the operation of the opening-closing mechanism.

The front surface in the image-forming apparatus corresponds to viewing the apparatus from the right side leftward in FIG. 1 from the left side rightward in FIG. 3A. The operator usually operates the apparatus at a position facing the front surface of the apparatus. The rotation axis of each member of the opening-closing mechanism extends substantially parallel to the front surface of the apparatus, and the cover 52 is configured to enable large opening on the front surface side of the apparatus. The display panel 51 is configured to move with respect to the main body in conjunction with the movement of the cover 52 while changing the posture with respect to the cover 52 such that the display direction of the display unit is maintained at a predetermined direction facing the position at which the operator performs the operations.

The cover 52 is supported by an arm 54 with respect to the main body top cover 53 of the image-forming apparatus so as to be rotatable about the rotation shaft 53*a*. The arm 54 rotates integrally with the cover 52. The display panel 51 is pivotally supported with respect to the cover 52 so as to be rotatable about a rotation shaft 51*a* and is provided movably with respect to the main body by a four-joint link mechanism. The configurations of the display panel 51, cover 52, main body top cover 53, and arm 54 are the same as those of the display panel 41, cover 42, main body top cover 43, and arm 44 in the conventional example shown in FIGS. 2A to 2F.

The four-joint link mechanism in the present example is constituted by a plurality of rotatably joined links. More specifically, the cover 52 and the arm 54 constitute the first link, the display panel 51 constitutes the second link, and the tip-side link member 55 and a base-side link member 56 constitute the third link. Those links are joined by the rotation shafts 51*a* and 51*b* to be mutually rotatable and are rotatably supported by the rotation shafts 53*a* and 56*a* with respect to the main body.

The tip-side link member 55 is configured to be rotatable about the rotation shaft 51*b* with respect to the display panel 51. The base-side link member 56 is configured to be rotatable about the rotation shaft 56*a* with respect to a base member 58 fixed to the main body frame (not shown in the figure) of the image-forming apparatus. The tip-side link member 55 and the base-side link member 56 form one link in the four-joint link mechanism and are configured integrally so that the relative displacement thereof results in the extension and contraction of the link. A compression spring 57 is bias means for elastically pushing the tip-side link member 55 with respect to the base-side link member 56 in the direction of extending the link.

In the opening-closing mechanism in the present example, a stopper 59 serving as an engaging portion is provided on the rear surface of the display panel 51 and moves integrally with the display panel 51 with respect to the main body. A stopper 60 serving as an engaged portion is fixed to the base member 58.

FIG. 3A shows the state in which the opening-closing mechanism (cover 52) is open. FIGS. 3G and 3H show the state in which the opening-closing mechanism (cover 52) is completely closed. FIGS. 3C and 3D show the state in the course of opening-closing, that is, the state between the entirely open state and entirely closed state. Where no article is inserted between the cover 52 and the display panel 51, the open state or closed state is assumed through this state. Thus, the cover 52 and the display panel 51 have mutually overlapping regions when the cover 52 is at the closed position, when viewed in the rotation axis direction (FIG. 3G, etc.). In this configuration, the angle formed by the cover and the display panel gradually increases, thereby forming a gap therebetween, as the cover 52 approaches the open position (FIG. 3A). Meanwhile, FIGS. 3E and 3F show the state in which the opening-closing mechanism stops the opening-closing operation because an article is present between the cover 52 and the display panel 51.

The angle formed by the cover 52 and the main body top cover 53 during the opening-closing operation, that is, the angle formed in the open state (FIG. 3A, etc.) by the portions of the cover 52 and the main body top cover 53 that are at a substantially the same angle (mutually parallel) in the closed state (FIG. 3G), is denoted by $\gamma$. Likewise, the angle formed in the open state by the portions of the cover 52 and the display panel 51 that are at a substantially the same angle in the closed state is denoted by $\delta$. When the cover 52 and the display panel 51 are closed from the open posture, the cover 52 rotates counterclockwise about the rotation shaft 53*a* shown in FIG. 3A, and the display panel 51 moves in conjunction with the movement of the cover 52 and rotates in the direction shown in FIG. 3A. Therefore, when the cover 52 and the display panel 51 are closed, the angle $\gamma$ and the angle $\delta'$ decrease gradually following the rotation of the cover 52.

Figure 3E:
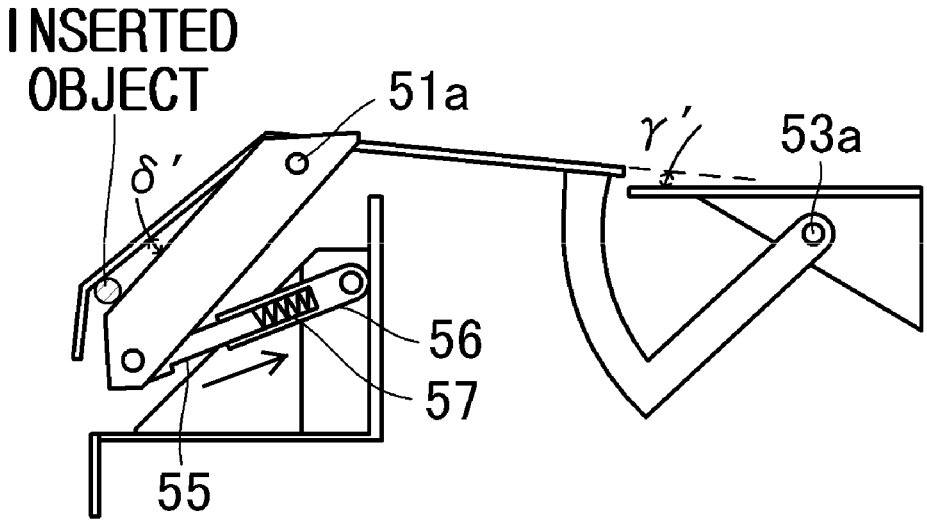
Figure 3F:
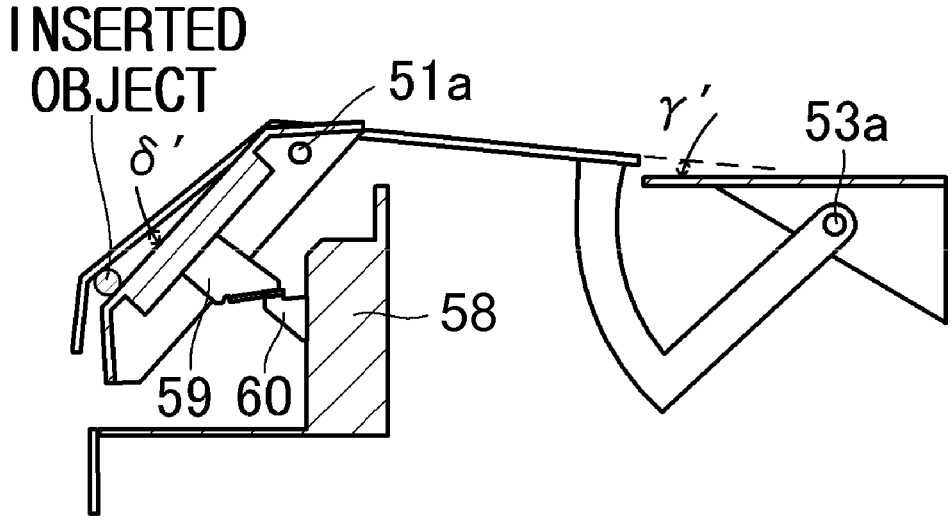
Figure 3G:
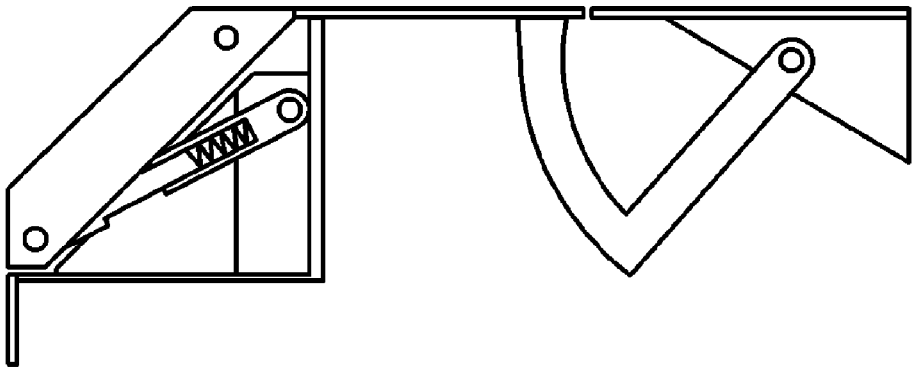
Figure 3H:
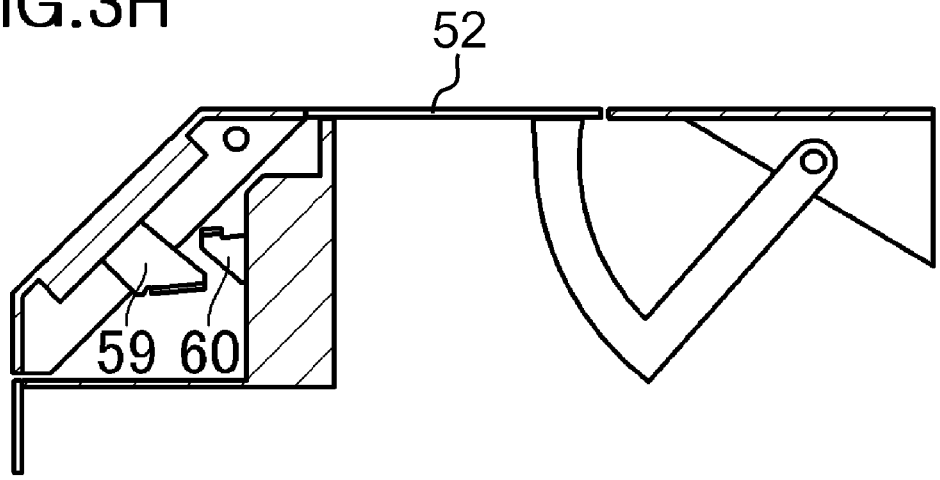

As shown in FIGS. 3E and 3F, where the opening-closing portion continues the closing operation and the angle 6 gradually decreases in the state in which an article is inserted into a gap between the cover 52 and the display panel 51, a state is reached in which the article inserted into the gap is jammed between the cover 52 and the display panel 51. Where such a state is reached, the reaction force received from the article inserted into the gap switches the movement path of the display panel 51. More specifically, the usual movement path (first path) in which the movement proceeds while the gap is reduced (while the angle 6' is decreased) in the state in which no article is inserted into the gap is switched to a movement path (second path) in which the movement proceeds without reducing the gap. The second path changes depending on the size of the article inserted into the gap. The movement of the cover 52 and the display panel 51 is stopped (restricted) by the engagement of the stopper 59 and the stopper 60. The stopping position also changes depending on the size of the article inserted into the gap. As a result, the inserted object can be prevented from being strongly squeezed between the cover 52 and the display panel 51.

Thus, as shown in FIGS. 3E and 3F, where the opening-closing portion is closed to an angle δ' while an article is jammed in the portion of angle δ', the movement resulting in the decrease of the angle δ' is inhibited, the tip-side link member 55 moves in the direction shown by an arrow in relation to the base-side link member 56, and the link length is reduced. Where the cover 52 is further rotated in this state in the closing direction, the angle δ' does not change, and the link member 55 is further gradually pressed against the base-side link member 56, following the decrease in an angle γ', against the action of the compression spring 57. Meanwhile, when no article is inserted into the gap, the angle δ' decreases following the decrease in the angle γ'.

As indicated hereinabove, as a result of the retraction of the tip-side link member 55, the display panel 51 rotates counterclockwise about the rotation shaft 51*a* as a fulcrum, and the position of the stopper 59 changes in the direction of decreasing radius of the movement path around the rotation shaft 53*a*. Where the cover 52 and the display panel 51 are rotated counterclockwise about the rotation shaft 53*a* in this state, the stopper 59 advances along the trajectory of engagement with the stopper 60. In other words, the movement trajectory of the display panel 51 in the case where the opening-closing operation is performed in the state in which an article is inserted between the cover 52 and the display panel 51 is different from that when no article is present.

Comparing FIG. 3D with FIG. 3F, the angle γ' is the same, but it can be easily seen that the movement trajectories of the display panel 51 and the stopper 59 moving integrally with the display panel 51 have changed. FIG. 3D shows the positional relationship between the stopper 59 and the stopper 60 in the case in which an article is not inserted into the gap. When the article is not inserted, the cover 52 moves to the position (closed position) shown in FIG. 3H, without the engagement of the stopper 59 and the stopper 60 at the closing trajectory thereof.

[Configuration of Stopper Portion]

The configuration of the stopper portion will be described hereinbelow in greater detail with reference to FIGS. 4A to 4D. In the opening-closing mechanism according to the present example, the stopper portion (locking mechanism) is configured to be capable of functioning regardless of the size of the article inserted between the cover 52 and the display panel 51, that is, to be capable of performing the abovementioned stopping operation when the inserted article is large and when it is small.

Figure 4A:
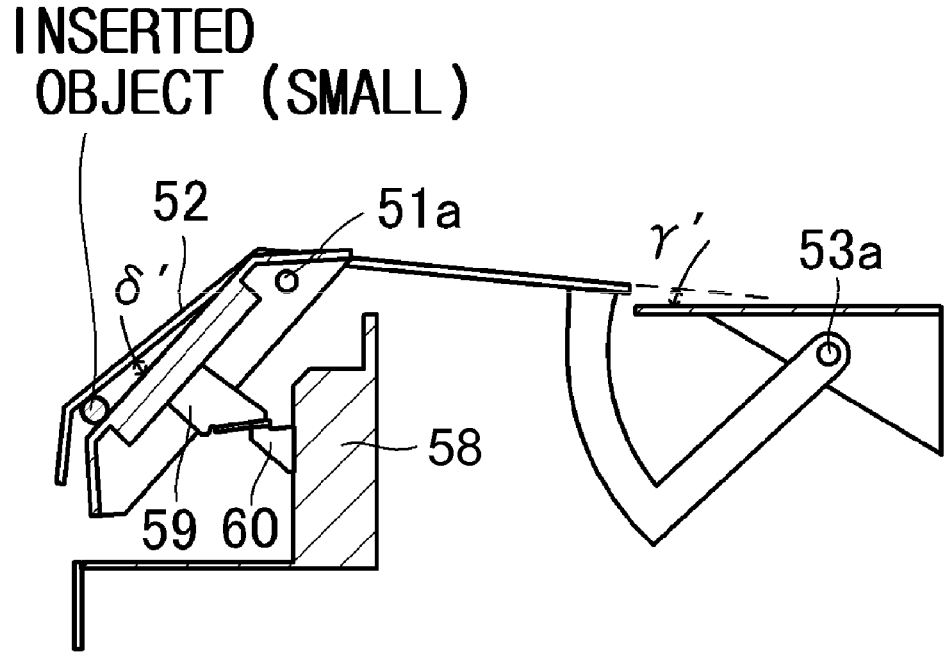
FIGS. 4A to 4D are schematic drawings showing the configuration of the opening-closing mechanism according to Example 1 of the present invention.
Figure 4B:
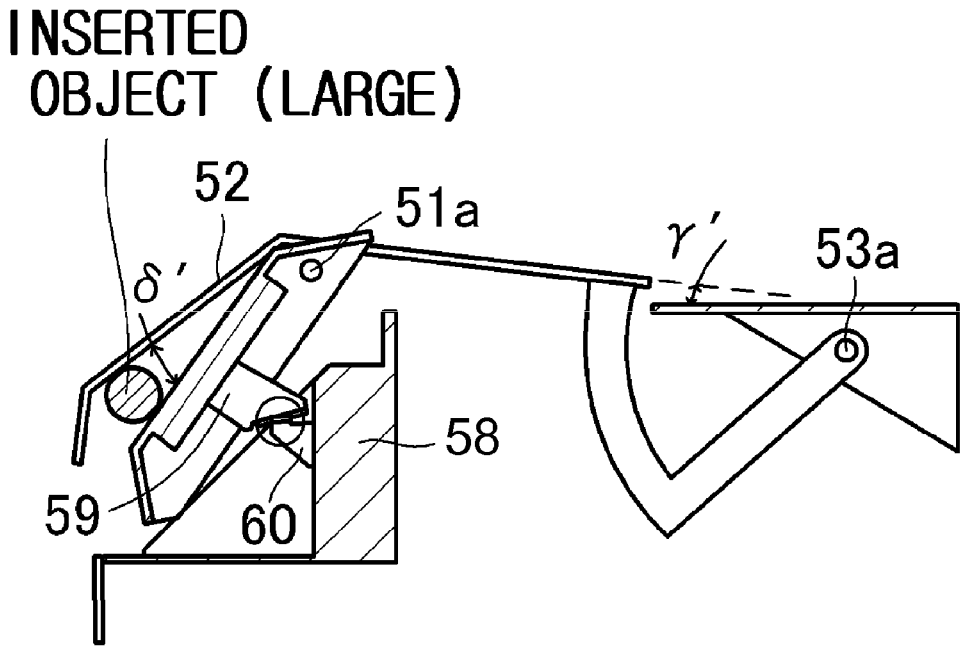
Figure 4C:
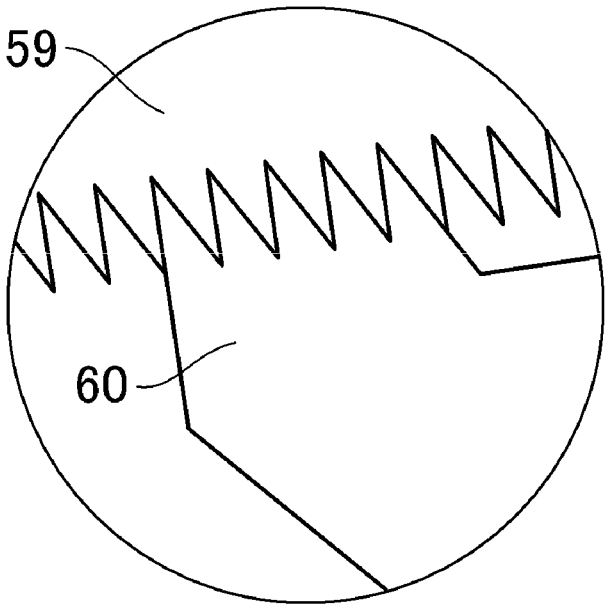
Figure 4D:
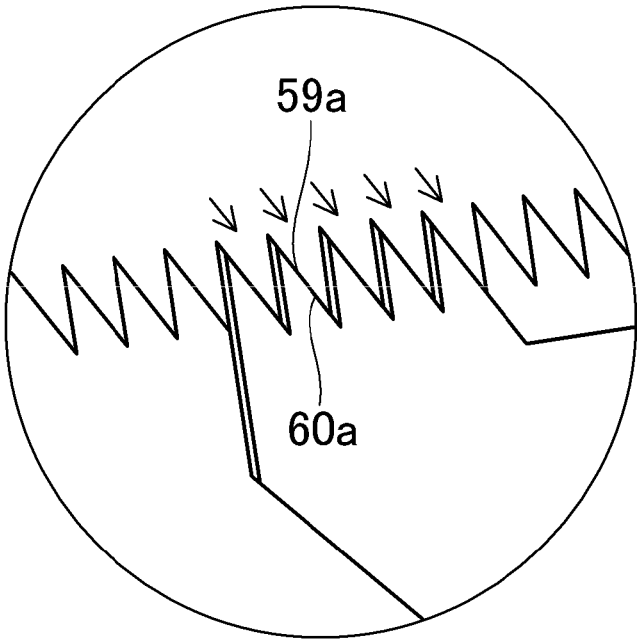

FIG. 4A is a schematic cross-sectional view illustrating the state in which the stoppers 59 and 60 are engaged when a small object is inserted between the cover 52 and the display panel 51. FIG. 4B is a schematic cross-sectional view illustrating the state in which the stoppers 59 and 60 are engaged when a large object is inserted between the cover 52 and the display panel 51. FIG. 4C is an enlarged view of FIGS. 4A and 4B showing the engaged state of the stoppers 59 and 60. FIG. 4D is an enlarged view of FIGS. 4A and 4B showing a state immediately before the stopper 59 and the stopper 60 are fully engaged.

The stopper 59 on the display panel 51 side is formed as an engaging portion having a large number of sawtooth-shaped protrusions. The stopper 60 on the opposing fixed side is formed as an engaged portion which is provided with a plurality of protrusions to be engaged with the protrusions of the stopper 59. As shown in FIGS. 4A and 4B, the retraction amount of the link member 55 differs depending on the difference in size between the inserted objects, but with the abovementioned configuration, any of the plurality of protrusions of the stopper 59 can engage with the fixed stopper 60.

As shown in FIG. 4D, when the stopper 59 and the stopper 60 are engaged, the respective inclined surface 59*a* and inclined surface 60*a* thereof come into mutual contact immediately before the engagement, and the stopper 59 moves while the protrusions thereof slide on the inclined surface 60*a* of the stopper 60. With such a configuration, a reaction force acting in the direction of expanding the gap between the cover 52 and the display panel 51 acts from the stopper 60 upon the stopper 59. Therefore, the display panel 51 is prevented from rotating in the direction of decreasing the angle δ (or δ') by the sliding of the stoppers.

In the present example, the stopper portion is configured by providing the fixed stopper 60 with 5 protrusions and providing the movable stopper 59 with 6 or more protrusions, but such a configuration is not limiting. For example, the number of protrusions on the movable stopper 59 may be 6 or more and the number of protrusions on the fixed stopper 60 may be 5. Further, in the present example, the engaging portions and engaged portions have a sawtooth shape, but such a shape is not limiting, and other uneven shapes may be used, provided that the same function can be demonstrated.

The locking configuration using the engagement of unevenly shaped portions, as in the present example, is not limiting. For example, a configuration may be used in which members having a high friction coefficient are disposed on the stopper surfaces, and the stoppers are locked by the friction of the members. Further, in the present example, the stopper portion that locks the operation of the four-joint link and cover 52 is provided between the display panel 51 and the base member 58, but it may be also provided at other members. The size of the stopper protrusions and the angle γ' obtained when the stoppers are engaged can be set, as appropriate, according to the specifications of the apparatus.

As mentioned hereinabove, in the present example, members constituting the opening-closing portion move when an external force equal to or higher than a predetermined force is applied to the location preventing an article from being jammed, and the movement of the opening-closing portion can be stopped by the engagement of the stoppers when the opening-closing portion is closed in the state in which the members have moved. As a result, when an article is inserted into the gap of the opening-closing mechanism, the article can be prevented from being jammed even stronger. Therefore, the operator can be prevented from strongly closing the opening-closing portion in the state in which an article has been erroneously inserted into the spatial portion between the first opening-closing portion (opening-closing member) and the second opening-closing portion (opening-closing member or movable member). Further, with such a configuration the stoppers can be engaged regardless of the size of the inserted object, that is, when the inserted object is large and when it is small, and the object can be prevented more reliably from being jammed. Further, since the present invention can be realized with simple mechanism parts and does not require expensive electric parts and mechatronic parts, no significant increase in cost is required. In the present example, the operation of the display portion and cover as the operation portions is explained by way of example, but it goes without saying that the present invention can be also applied to a configuration in which even when other constituent elements are present, a plurality of segments perform opening and closing along respective trajectories by moving in conjunction with each other.

Example 2

The opening-closing mechanism according to Example 2 of the present invention will be explained below with reference to FIGS. 5A to 6H. The configuration of the present example is provided with a link mechanism including a slider joint. Components that are different from those of Example 1 are mainly explained herein, and those shared with Example 1 are assigned with same reference numerals and the explanation thereof is herein omitted. The features that are not specifically explained herein are same as in Example 1.

[Configuration of Opening-Closing Cover, Slider Link Portion, and Stopper Portion]

Figure 5A:
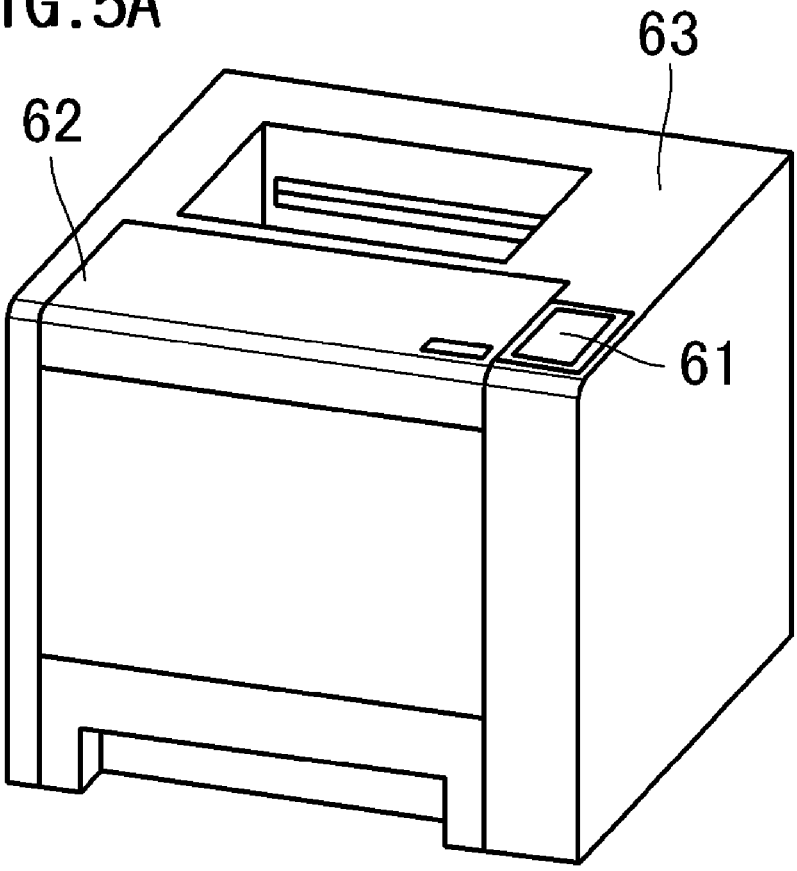
FIGS. 5A to 5D are schematic drawings showing the configuration of the opening-closing mechanism according to Example 2 of the present invention.
Figure 5B:
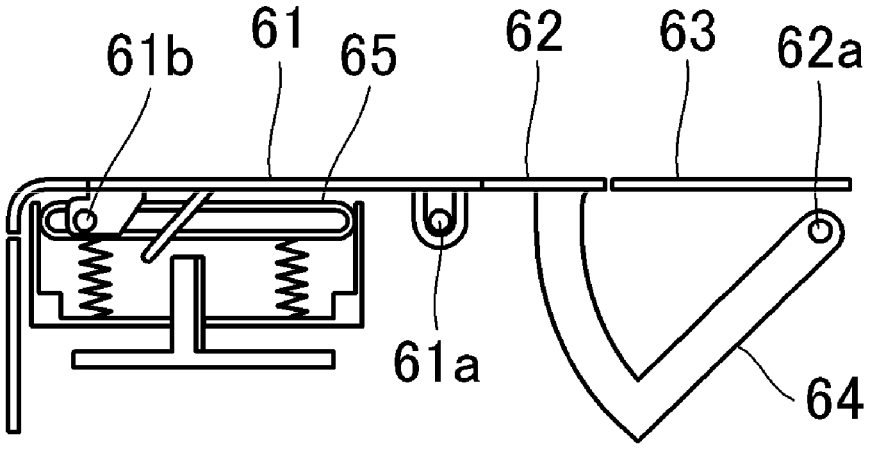
Figure 5C:
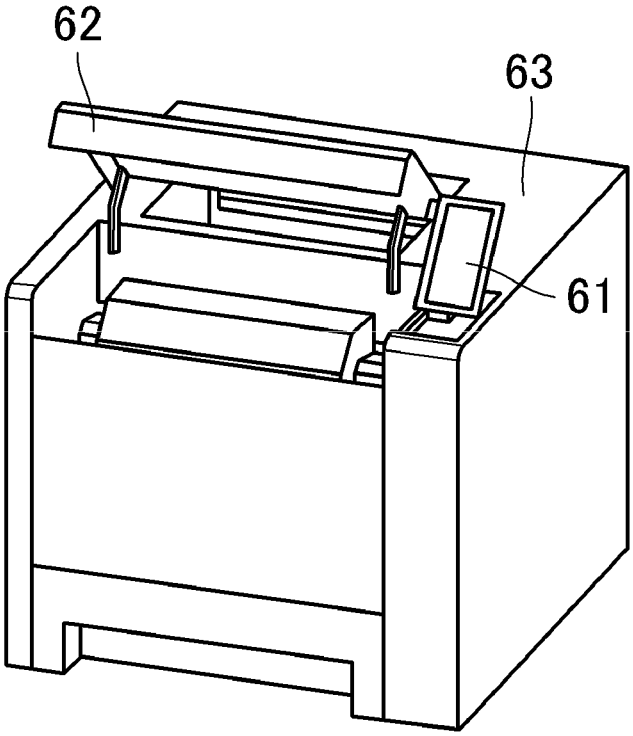
Figure 5D:
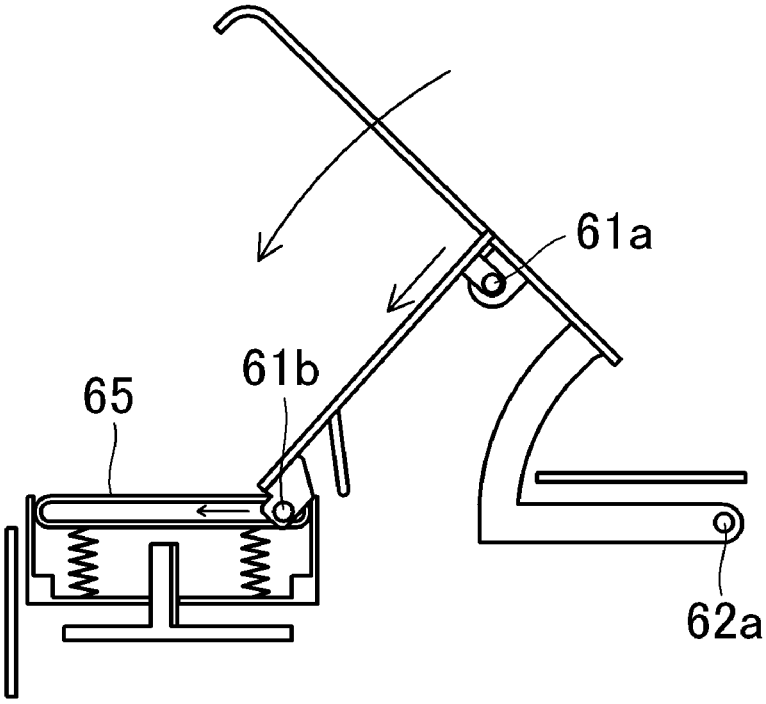

FIGS. 5A to 5D are schematic diagrams illustrating the configuration of the opening-closing mechanism according to Example 2 of the present invention. FIG. 5A is a perspective view of the main body of the image forming apparatus in the state in which the cover 62 is closed. FIG. 5B is a view taken from the direction of the right-side surface of the main body which illustrates schematically the slider link mechanism configuration in the state in which the cover 62 is closed. FIG. 5C is a perspective view of the main body of the image forming apparatus in the state in which the cover 62 is open. FIG. 5D is a view taken from the direction of the right-side surface of the main body which illustrates schematically the slider link mechanism configuration in the state in which the cover 62 is open.

The opening-closing mechanism of the present example is provided with the cover 62 as an opening-closing member and a display panel 61 as a movable member connected to the cover 62. The cover 62 is supported to be rotatable about a rotation shaft 62*a* by an arm 64 with respect to a main body top surface cover 63 of the image-forming apparatus. The arm 64 rotates integrally with the cover 62. The display panel 61 is supported to be rotatable about a rotation shaft 61*a* with respect to the cover 62 and provided to be movable with respect to the main body by a slider link mechanism. More specifically, the display panel 61 is held by an engaging portion 61*b* to be capable of rotating and sliding with respect to a guide portion 65.

As shown in FIGS. 5A to 5D, the image-forming apparatus of the present example is configured such that the display of the display panel 61 is horizontal when the cover 62 is closed and such that the display rises vertically when the cover 62 is open. The movement performed during the transition of the cover 62 and other constituent members from the open state to the closed state is shown by an arrow in FIG. 5D.

Figure 6A:
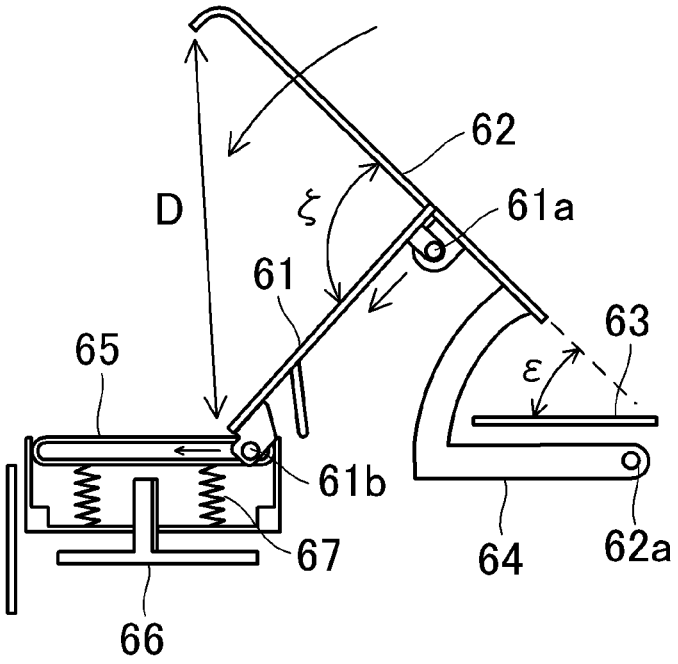
FIGS. 6A to 6H are schematic diagrams showing the configuration of the opening-closing mechanism according to Example 2 of the present invention.
Figure 6B:
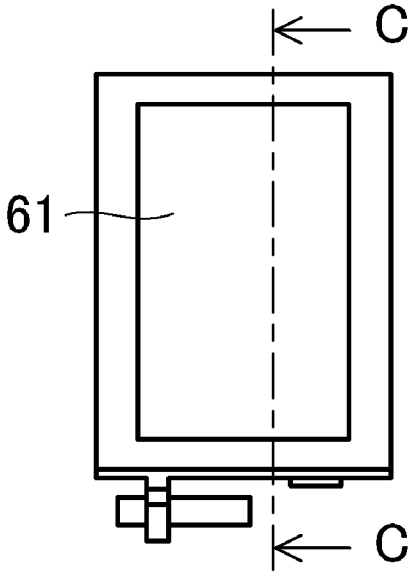
Figure 6C:
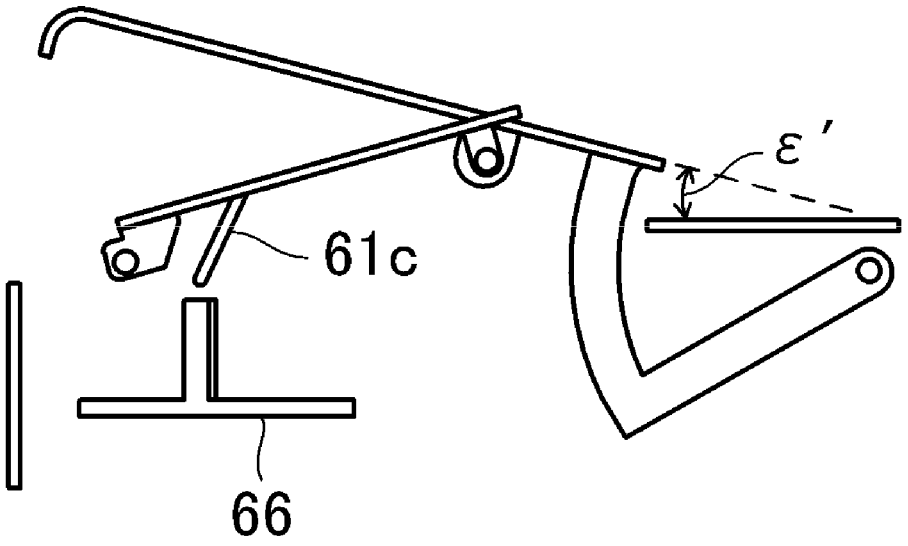
Figure 6D:
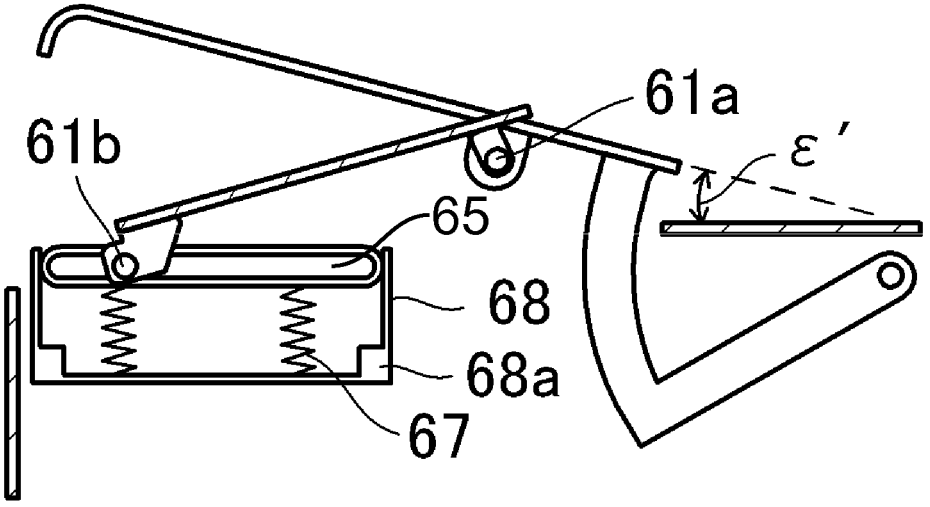
Figure 6E:
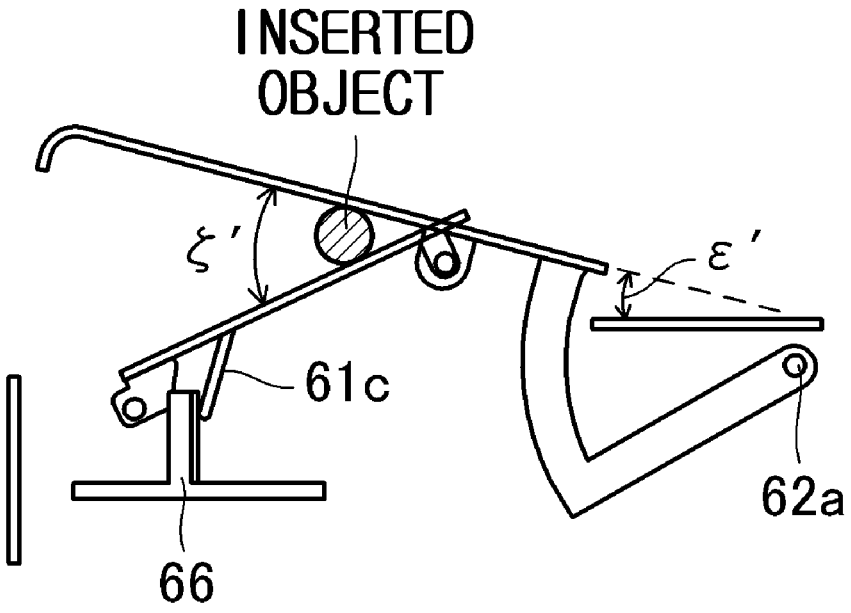
Figure 6F:
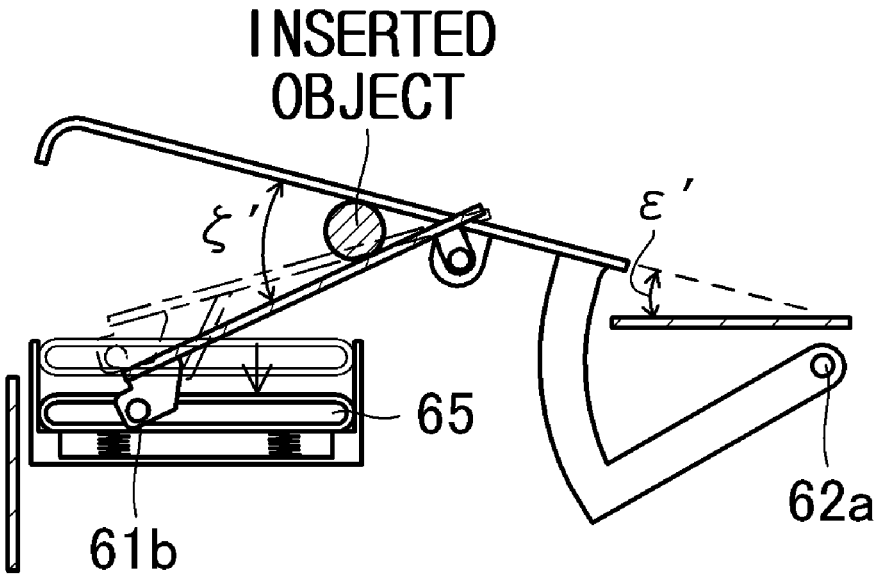
Figure 6G:
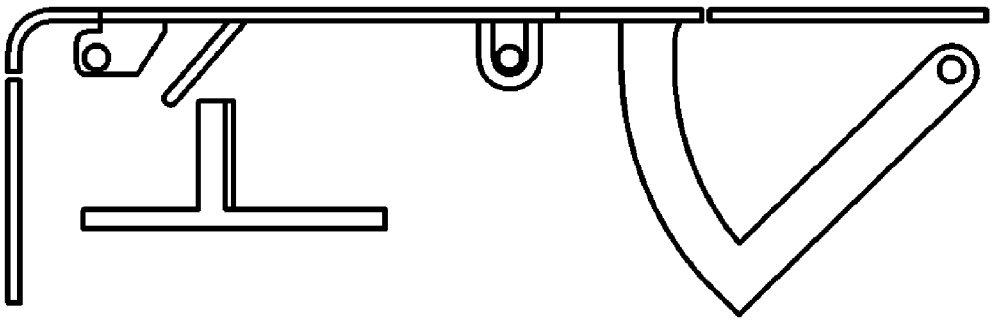
Figure 6H:
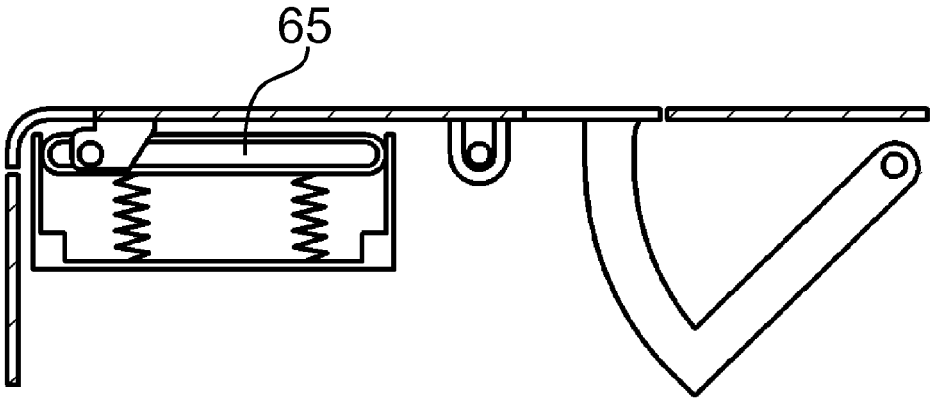

The operation of the stopper is explained below with reference to FIGS. 6A to 6H. FIG. 6A is a view taken from the right-side surface direction of the main body and showing schematically the state in which the cover 62 is open. FIG. 6B is a view of the display panel 61 taken from above. FIG. 6C is a view taken from the right-side surface direction of the main body and showing schematically the state in which no article is inserted between the cover 62 and the display panel 61 when the cover 62 performs the closing operation. FIG. 6D is a cross-sectional view taken from the right-side surface direction of the main body and representing schematically the state in which no article is inserted between the cover 62 and the display panel 61 when the cover 62 performs the closing operation, this cross section corresponding to the CC cross section in FIG. 6B. FIG. 6E is a view taken from the right-side surface direction of the main body and showing schematically the state in which an article is inserted between the cover 62 and the display panel 61 when the cover 62 performs the closing operation. FIG. 6F is a cross-sectional view taken from the right-side surface direction of the main body and representing schematically the state in which an article is inserted between the cover 62 and the display panel 61 when the cover 62 performs the closing operation, this cross section corresponding to the CC cross section in FIG. 6B. FIG. 6G is a view taken from the right-side surface direction of the main body and representing schematically the state in which the cover 62 is closed. FIG. 6H is a is a cross-sectional view taken from the right-side surface direction of the main body and representing schematically the state in which the cover 62 is closed, this cross section corresponding to the CC cross section in FIG. 6B.

In FIGS. 6A to 6H, the reference numeral 65 stands for a guide member that guides the sliding movement of the engaging portion 61*b* of the display panel 61 in the left-right direction shown in the figure. The guide member is held to be capable of moving in the up-down direction shown in the figure inside an accommodation member 68. The reference numeral 67 stands for biasing means for pushing the guide member 65. An angle formed by the cover 62 and the main body top surface cover 63 is denoted by $\epsilon$, and an angle formed by the surface portions of the cover 62 and the display panel 61 is denoted by $\zeta$. When the cover 62 and the display panel 61 are closed from the open posture, the cover 62 rotates counterclockwise about the rotation shaft 62*a* shown in FIG. 6A. In this case, the display panel 61 moves in conjunction with the movement of the cover 62 due to the movement of a connection portion (rotation shaft 61*a*) connecting the display panel to the cover 62 and the sliding movement of a portion 61*b* inside the guide member 65, and the display panel slides in the direction shown by the arrow in FIG. 6A. Therefore, when the cover 62 and the display panel 61 are closed, the angles $\epsilon$ and $\zeta$ decrease gradually following the rotation of the cover 62. When no article is inserted into a space D between the cover 62 and the display panel 61, the guide member 65 does not move from the position shown in FIGS. 6A, 6D and 6H.

Where the opening-closing portion is closed when an article is interposed between the cover 62 and the display panel 61, as shown in FIGS. 6E and 6F, the decrease in the angle $\zeta$ is hindered by the jammed article, and a downward external force is applied to the guide member 65 through the display panel 61. As a result, instead of the decrease in the angle $\zeta'$, the guide member 65, which is capable of parallel movement, moves downward against the biasing force of the urging member 67. Where the cover 62 is further rotated in the closing direction in this state, the bottom surface of the guide member 65 moves to the position of abutment against an engaging portion 68*a* provided at the bottom of the accommodation portion 68 of the guide member. As a result, the slider guide 65 moves to a position different from that in the state in which no article is interposed between the cover 62 and the display panel 61. Where the cover 62 is rotated counterclockwise about a rotation fulcrum (rotation shaft 62*a*) in this state, the display panel 61 slides along a trajectory of engagement of the stopper 61*c* and the stopper 66 fixed to the frame of the main body. In other words, when the display panel 61 is opened or closed in the state in which an article is interposed between the cover 62 and the display panel 61, the display panel follows a trajectory different from that when no article is interposed. Further, comparing FIG. 6C and FIG.

6E, the angle ε' is the same, but it can be clearly seen that the display panel 61 and the stopper 61*c* operating integrally with the display panel 61 pass through different positions. Where the stopper 61*c* abuts against the fixed-side stopper 66, the display panel 61 cannot slide any more inside the guide member 65. As a result, the display panel 61 and the cover 62 stop the opening-closing operation, and the interposed object can be prevented from being strongly jammed.

The configuration of the abovementioned examples can be used in combinations. For example, the engagement configuration using the sawtooth-shaped engaging portion of Example 1 may be used in the configuration of the stopper portion of Example 2. Further, a four-joint link mechanism is used in the present examples, but other multijoint link mechanisms may be also used.

In accordance with the present invention, when an article is inserted into a gap, the article can be prevented from being jammed even stronger.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-125006, filed Jun. 13, 2013 which is hereby incorporated by reference herein in its entirety.

What is claimed is:

1. An opening-closing mechanism comprising:

an opening-closing member movable, with respect to a main body of an image-forming apparatus, between an open position in which the interior of the main body is open and a closed position in which the interior of the main body is closed; and a movable member movable, with respect to the main body, in conjunction with movement of the opening-closing member such that a gap between the movable member and the opening-closing member is reduced as the opening-closing member moves from the open position toward the closed position, the movable member including a display unit, which displays information about the image-forming apparatus, wherein the movable member moves in conjunction with the movement of the opening-closing member while changing the position and orientation relative to the opening-closing member such that a display direction of the display unit is maintained at a predetermined direction, and when an article is not inserted into the gap between the movable member and the opening-closing member during the movement of the opening-closing member from the open position toward the closed position, the movable member moves along a first path, and when the article is inserted into the gap between the movable member and the opening-closing member during the movement of the opening-closing member from the open position toward the closed position, the movable member moves along a second path which is different from the first path and in which the gap is not reduced.

2. The opening-closing mechanism according to claim 1, wherein the movable member has an engaging portion that engages with an engaged portion, which is provided on the main body, and stops the movement of the opening-closing member and the movable member when a movement path of the movable member has been switched to the second path.

3. The opening-closing mechanism according to claim 2, wherein a position at which the engaging portion engages with the engaged portion differs according to a size of the article inserted into the gap.

4. The opening-closing mechanism according to claim 2, wherein the engaging portion is configured to receive, from the engaged portion, a reaction force acting to expand the gap during the engagement with the engaged portion.

5. The opening-closing mechanism according to claim 1, wherein the movable member is supported rotatably with respect to the opening-closing member and disposed side by side with the opening-closing member in a rotation axis direction, and the movable member has a region overlapping the opening-closing member when the opening-closing member is in the closed position, as viewed in the rotation axis direction, and the gap is formed due to an angle, which is formed by the movable member and the opening-closing member, the angle increasing as the opening-closing member approaches the open position.

6. The opening-closing mechanism according to claim 4, wherein the movable member is movable with respect to the main body through a link mechanism including a plurality of rotatably joined links, and the link mechanism is configured such that a length of at least one link is changed by the reaction force.

7. The opening-closing mechanism according to claim 6, wherein, when the reaction force does not act, the at least one link is biased by an urging member to have a first length at which the first path is used as the movement path, and a second length of the at least one link at which the second path is used as the movement path changes according to a size of the article inserted into the gap.

8. The opening-closing mechanism according to claim 4, wherein the movable member is movable with respect to the main body through a link mechanism including a plurality of rotatably joined links and at least one slider joint, and the link mechanism is configured such that a position of the at least one slider joint is changed by the reaction force.

9. The opening-closing mechanism according to claim 8, wherein, when the reaction force does not act, the at least one slider joint is biased by an urging member to assume a first position at which the first path is used as the movement path, and a second position of the at least one slider joint at which the second path is used as the movement path changes according to a size of the article inserted into the gap.

10. An image-forming apparatus that forms an image on a recording medium, the image-forming apparatus comprising:

an opening-closing member movable, with respect to a main body of the image-forming apparatus, between an open position in which the interior of the main body is open and a closed position in which the interior of the main body is closed; and a movable member movable, with respect to the main body, in conjunction with movement of the opening-closing member such that a gap between the movable member and the opening-closing member is reduced as the opening-closing member moves from the open position toward the closed position, the movable member including a display unit, which displays information about the image-forming apparatus, wherein the moveable member moves in conjunction with the movement of the opening-closing member while changing the position and orientation relative to the opening-closing member such that a display direction of the display unit is maintained at a predetermined direction, and wherein when an article is not inserted into the gap between the movable member and the opening-closing member during the movement of the opening-closing member from the open position toward the closed position, the movable member moves along a first path, and when the article is inserted into the gap between the movable member and the opening-closing member during the movement of the opening-closing member from the open position toward the closed position, the movable member moves along a second path which is different from the first path and in which the gap is not reduced.

11. The image-forming apparatus according to claim 10, wherein the movable member has an engaging portion that engages with an engaged portion, which is provided on the main body, and stops the movement of the opening-closing member and the movable member when a movement path of the movable member has been switched to the second path.

12. The image-forming apparatus according to claim 11, wherein a position at which the engaging portion engages with the engaged portion differs according to a size of the article inserted into the gap.

13. The image-forming apparatus according to claim 11, wherein the engaging portion is configured to receive, from the engaged portion, a reaction force acting to expand the gap during the engagement with the engaged portion.

14. The image-forming apparatus according to claim 10, wherein the movable member is supported rotatably with respect to the opening-closing member and disposed side by side with the opening-closing member in a rotation axis direction; and the movable member has a region overlapping the opening-closing member when the opening-closing member is in the closed position, as viewed in the rotation axis direction, and the gap is formed due to an angle, which is formed by the movable member and the opening-closing member, the angle increasing as the opening-closing member approaches the open position.

15. The image-forming apparatus according to claim 13, wherein the movable member is movable with respect to the main body through a link mechanism including a plurality of rotatably joined links, and the link mechanism is configured such that a length of at least one link is changed by the reaction force.

16. The image-forming apparatus according to claim 15, wherein, when the reaction force does not act, the at least one link is biased by an urging member to have a first length at which the first path is used as the movement path, and a second length of the at least one link at which the second path is used as the movement path changes according to a size of the article inserted into the gap.

17. The image-forming apparatus according to claim 13, wherein the movable member is movable with respect to the main body through a link mechanism including a plurality of rotatably joined links and at least one slider joint, and the link mechanism is configured such that a position of the at least one slider joint is changed by the reaction force.

18. The image-forming apparatus according to claim 17, wherein, when the reaction force does not act, the at least one slider joint is biased by an urging member to assume a first position at which the first path is used as the movement path, and a second position of the at least one slider joint at which the second path is used as the movement path changes according to a size of the article inserted into the gap.

19. An opening-closing mechanism comprising:

an opening-closing member movable, with respect to a main body of an image-forming apparatus, between an open position in which the interior of the main body is open and a closed position in which the interior of the main body is closed; and a movable member movable, with respect to the main body, in conjunction with movement of the opening-closing member such that a gap between the movable member and the opening-closing member is reduced as the opening-closing member moves from the open position toward the closed position, the movable member including an engaging portion that engages with an engaged portion, which is provided on the main body, and stops the movement of the opening-closing member and the movable member when the movement path of the movable member has been switched to a second path, the engaging portion being configured to receive, from the engaged portion, a reaction force acting to expand the gap during the engagement with the engaged portion, wherein when an article is not inserted into the gap between the movable member and the opening-closing member during the movement of the opening-closing member from the open position toward the closed position, the movable member moves along a first path, and when an article is inserted into the gap between the movable member and the opening-closing member during the movement of the opening-closing member from the open position toward the closed position, the movable member moves along a second path which is different from the first path and in which the gap is not reduced, and the movable member is provided to be movable with respect to the main body through a link mechanism including a plurality of rotatably joined links, the link mechanism being configured such that a length of at least one link is changed by the reaction force.

* * * * *